United States Patent [19]

Taylor et al.

[11] 4,103,271

[45] Jul. 25, 1978

[54] THERMOSTATS

[76] Inventors: John Crawshaw Taylor, Edge Lee, Bishops La.; Richard Antony Phillips, Ruabon, 145 Light Wood Rd., both of Buxton, Derbyshire, England

[21] Appl. No.: 785,096

[22] Filed: Apr. 6, 1977

[30] Foreign Application Priority Data

Apr. 8, 1976 [GB] United Kingdom ..... 14331/76

[51] Int. Cl.[2] ..... H01H 37/04; H01H 37/52

[52] U.S. Cl. ..... 337/372; 337/380

[58] Field of Search ..... 337/372, 365, 368, 354, 337/343, 380, 347, 349, 360

[56] References Cited

U.S. PATENT DOCUMENTS

| | | | |
|---|---|---|---|
| 2,707,738 | 5/1955 | Weissheimer et al. | 337/372 |
| 3,577,111 | 5/1971 | Nardulli | 337/372 |
| 3,949,344 | 4/1976 | Hancock et al. | 337/347 |
| 4,039,992 | 8/1977 | Givler | 337/372 |

*Primary Examiner*—Harold Broome

[57] ABSTRACT

A thermostat includes a bimetallic snap-action disc for actuating an electrical switch, a stop engaging one edge portion of the disc, a switch contact operating member engaging an opposite disc edge portion, and a fulcrum disposed between the disc edge portions and about which the disc moves whereby to amplify the movement of the disc. The fulcrum is formed by an appropriate shaping of a base wall of a thermostat housing. The switch contacting operating member is arranged to act on a leaf spring mounting a movable switch contact that engages the free end of a tongue formed by a U-shaped slot within the leaf spring whereby to permit overtravel of the disc without causing significant alteration of the disc opening temperature.

10 Claims, 7 Drawing Figures

THERMOSTATS

This invention relates to a thermostat and more particularly, though not exclusively, to a thermostat to be positioned in the wall of a vehicle radiator and arranged to control a radiator cooling fan.

The present invention provides a thermostat including an electrical switch and a switch actuator comprising a bimetallic disc movable between oppositely dished configurations with a snap action, a stop engageable with one edge portion of the disc, a switch contact operating member engageable with a generally diametrically opposite disc edge portion, a fulcrum engageable with said disc and about said disc moves during its snap-action, the fulcrum being disposed intermediate said disc edge portions and at or near the centre of the disc.

By the arrangement of the stop, fulcrum and operating member in accordance with the invention there is provided an amplification of the movement of the disc during the snap action. This permits a less precise and hence less expensive assembly of the thermostat than in prior thermostats having no amplification of disc movement (when the movement may be of the order of the dimensional inaccuracies of other components) whilst not risking faulty operation of the thermostat. Moreover assuming a supply of accurately temperature set discs the greater switch-operating movement available in a thermostat according to the present invention permits a construction such that temperature calibration of individual thermostats can be avoided.

Said fulcrum is disposed at or near the centre of the disc in order to ensure that no undue stresses are created on the disc, which stresses may affect or prevent operation of the disc. Preferably, the fulcrum is disposed nearer the stop than the operating member in order to maximise the amplification of disc movement. An optimum amplification has been found to be where the ratio of the distance between the operating member and the fulcrum to the distance between the fulcrum and the stop is two to one. Such ratio whilst providing a large amount of movement of the operating member does not increase the leverage with which the operating member acts on the disc during the snap action movement to such an extent that the operating temperature of the disc is affected significantly. The stop preferably for simplicity in assembly comprises a peg located above the disc. For simplicity the peg may be fixedly mounted to a body of the thermostat although it may be desirable for the position of the peg to be adjustable, e.g. a screw threaded peg to be employed mounted in a screw threaded bore, so that by adjusting the position of the stop the disc may be accurately located in position so that the corresponding contact movements and contact pressures may be similarly accurately controlled. This also allows discs of different operating temperatures and hence dimensions, to be employed in the same mounting.

The stop and operating member are preferably located closely adjacent to the edge of the disc so that the maximum amount of movement of the disc is employed.

The fulcrum is preferably provided by a portion of the base of a thermostat housing, the disc being disposed adjacent the base. Preferably the portion is circular in plan and located in the centre of the housing, the housing being generally cylindrical and the base circular, so that it is not necessary to orientate the disc or the other components of the thermostat relative to the housing for correct assembly.

The portion may be provided by inwardly deforming the entire base or merely a central part of the base. In order to provide an increased amplification of the movement of the disc acting on the push rod, all or part of the base may be rectangular or have some other quadrilateral shape in section so that the fulcrum against which the disc operates is provided by an edge of the portion nearer the stop.

In a preferred feature of the invention, the operating member is arranged to act on a spring biasing the movable contact, the spring having a sufficiently low rate that the force required of the disc to move the spring does not affect the operating temperature of the disc to any significant extent and the spring being such that in use when the disc snap acts to close the switch contacts any movement of the disc beyond that required to provide sufficient pressure between the switch contacts for good electrical contact does not result in a substantially increased reaction force on the disc such as to modify the temperature at which the disc snap acts to open the switch contacts.

It would obviously be possible to construct a thermostat wherein the disc moved just enough in its snap-action to provide sufficient contact pressure without any overtravel of the disc occuring. However this would require unjustifiable care and expense in constructing the thermostat bearing in mind that the movement between oppositely dished configurations of the disc may not be very much greater than dimensional inaccuracies in moulded plastic parts which would normally form a thermostat body. Hence it is convenient to allow for overtravel of the disc without causing significant alteration of remake temperature. Since an amplified movement of the disc is provided in accordance with the invention, the provision of overtravel does not create any significant problems in ensuring the disc can still provide the necessary range of movement for opening the switch.

This may conveniently be effected where a leaf spring mounting a movable contact is provided, by weakening the leaf spring intermediate its mounting and the movable contact, such as by providing a slot therein, preferably generally U-shaped defining a tongue free at one end, the push rod engaging the free end of the tongue.

A particular advantage arising is that the overtravel permitted provides a contact wiping action by causing relative movement between the switch contacts whilst they are in contact thereby reducing the risk of the contacts welding together.

A preferred embodiment of this invention will now be described by way of example with reference to the accompanying drawings wherein.

Figure 1:
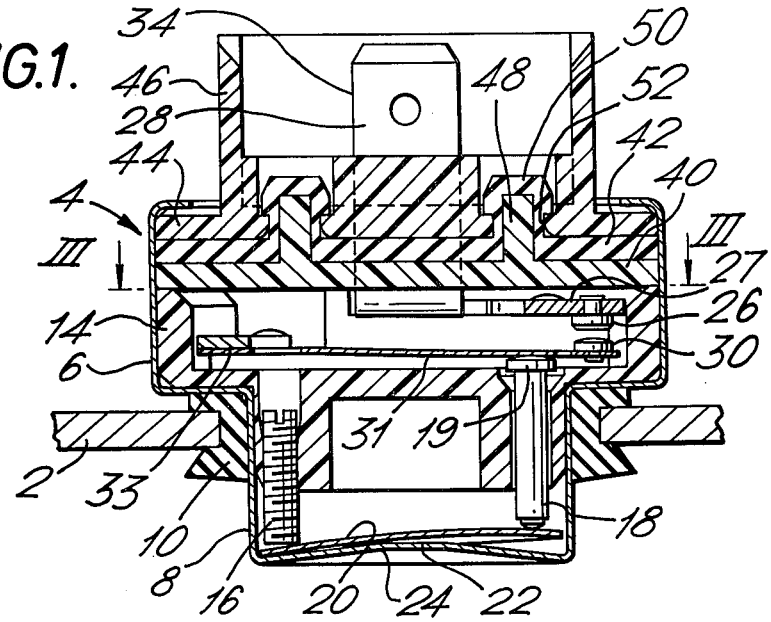
FIG. 1 is a sectional view of a vehicle cooling fan thermostat according to the invention with the switch contacts open.
Figure 2:
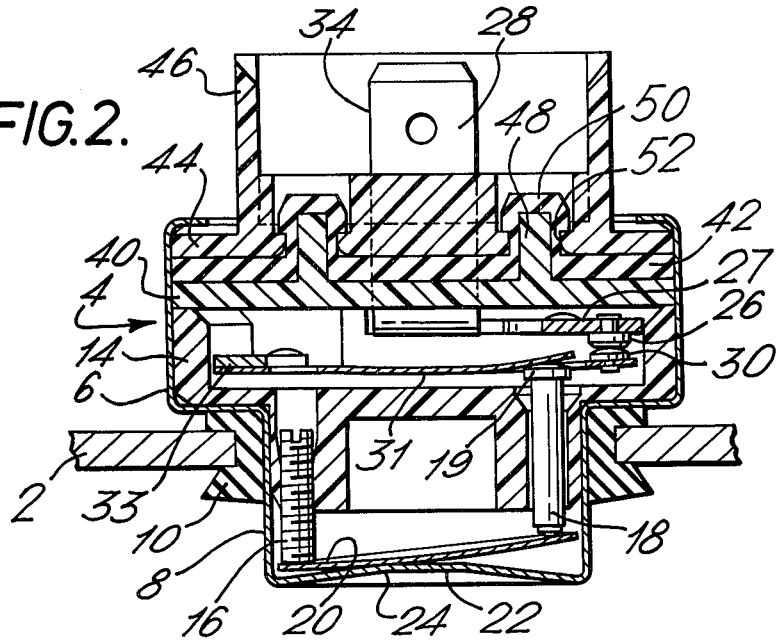
FIG. 2 is a view similar to FIG. 1 but with the switch contacts closed.

Referring to the drawings a thermostat is shown mounted in the wall 2 of a vehicle radiator. The thermostat comprises a cylindrical stainless steel housing 4 comprising two cylindrical portions of different diameter 6, 8, the smaller portion 8 being disposed in an aperture in the vehicle radiator wall 2. The thermostat is mounted in the vehicle radiator wall by a deformable bush 10 compressed between portion 8 of the housing and the radiator wall 2.

A plastics body 14 of fibre reinforced nylon is mounted within the housing parts 6, 8 and closes the bottom part 8 of the housing. Two diametrically opposite apertures mount a locating peg 16 and an operating member comprising a push rod 18. Push rod 18 has an enlarged head 19 to prevent the push rod escaping from the aperture during assembly. A bimetallic snap action disc 20 lies at the base of the housing and is retained by locating peg 16. Disc 20 has an accurately known operating temperature. The base wall of housing 4 tapers inwardly to provide a portion 22 in the centre of the base of the housing providing a fulcrum for movement of the disc. As shown, the base wall forms a truncated cone i.e. is trapezoidal in cross section and the edge 24 of portion 22 nearer peg 16 provides a fulcrum for the disc 20.

Peg 16 and push rod 18 are mounted in apertures as close as possible to the wall of housing portion 8. Peg 16 is screw threadedly mounted within the respective aperture so that it may be precisely positioned to retain disc 20 in position. A heat sink compound such as a silicon grease is provided between the disc and the base of the housing to provide efficient heat transfer therebetween.

Figure 3:
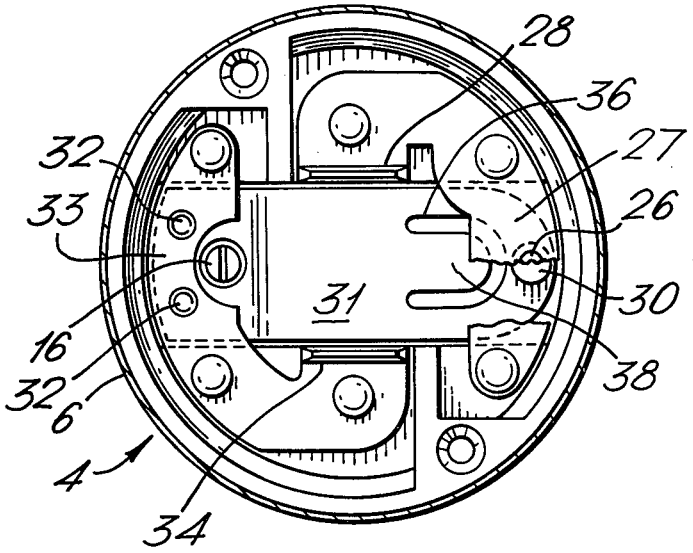
FIG. 3 is a plan view of the thermostat along the section line 3—3 of FIG. 1.

An electric switch is provided mounted on body 14 within housing part 6 and comprises a fixed contact 26 welded to an arcuate electrical conductor 27, (FIG. 3), conductor 27 being integral with an electric terminal 28. A movable contact 30 is mounted to the free end of a resilient conductive leaf spring 31. Spring 31 is riveted as at 32 to an arcuate electrical conductor 33 which is integral with an electrical terminal 34. Leaf spring 31 has in plan the shape shown in FIG. 3. A U-shaped slot 36 adjacent the free end of the strip provides a tongue 38 having a free end directed towards the movable contact 30. End 19 of push rod 18 engages the end of tongue 38.

The thermostat is sealed by provision of a circular plastics plate 40, and a circular resilient sealing disc 42 mounted above body 14. A rigid plastics circular cap member 44 encloses the whole assembly within the housing and has an upstanding tubular portion 46 enclosing terminals 28, 34. Upstanding pins 48 integral with plate 40 extend through bores in bosses 50 upstanding from disc 42 and serve to secure bosses 50 in apertures 52 in cap 44, thereby securing plate 40, disc 42 and cap 44 together. The top edge of brass housing 4 is pressed over cap 44 to retain the interior assembly in position.

In operation, with a low water temperature in the radiator, the disc has the configuration shown in FIG. 1 and the switch contacts are open, thereby preventing a radiator cooling fan from operating. As the temperature of the water in the vehicle radiator rises, the temperature of the disc rises and when the operating temperature of the disc is reached the disc snap acts to an oppositely dished configuration. Movement of the disc occurs about edge 24 of dimple 22 and results in upward movement of push rod 18, the movement of push rod 18 being more than twice that which would occur as in known arrangements where the push rod is positioned on the centre of the disc and no fulcrum is provided for the disc.

Upward movement of the push rod 18 moves leaf spring 31 upwardly so that contacts 26, 30 engage to close the switch so that the radiator cooling fan is switched on. Since the top end of rod 18 engages the free end of tongue 38 any movement of the push rod over and above that required to close the contacts 26, 30 with a sufficient contact pressure (for example 25 grams) results in movement of the tongue relative to the rest of the strip rather than increasing the contact pressure which would modify the operating temperature of the disc by a reaction force. Such movement of the tongue 38 also results in a flexing of the end of the strip mounting the contact 30 which results in a contact wiping action to prevent welding of the contacts when the switch is opened or closed.

The provision of overtravel, which is itself permitted from the amplified movement of the disc, results in the operating temperature of the disc not being significantly modified in any unpredictable manner. Since the operating temperature of the disc is accurately known, it is unnecessary to calibrate the thermostat after assembly and it is not essential to provide any means for adjusting the operating temperature of the thermostat and calibrating the thermostat, in contrast to known arrangements as for example described in British Patent Specification 1,229,185.

What is claimed is:

1. A thermostat including an electrical switch and a switch actuator comprising a bimetallic disc movable between oppositely dished configurations with a snap action, a stop engageable with one edge portion of the disc, a switch contact operating member engaging with a generally diametrically opposite disc edge portion, a fulcrum engageable with said disc and about which said disc moves during its snap-action, the fulcrum being disposed intermediate said disc edge portions and at or near the centre of the disc.

2. A thermostat as claimed in claim 1 wherein said fulcrum is disposed nearer said stop than said operating member.

3. A thermostat as claimed in claim 2 wherein the ratio of the distance between the operating member and the fulcrum to the distance between the fulcrum and the stop is two to one.

4. A thermostat as claimed in claim 1 wherein said stop is adjustable in position for accurately locating the disc.

5. A thermostat as claimed in claim 1 wherein said fulcrum comprises a portion of the base of a thermostat housing.

6. A thermostat as claimed in claim 5 wherein said base portion is circular in plan and located centrally of said base, said base being circular and said housing being generally cylindrical.

7. A thermostat as claimed in claim 5 wherein said base has a quadrilateral cross-section so that said fulcrum is provided by an edge of the central portion of the quadrilateral.

8. A thermostat as claimed in claim 1 wherein said operating member is arranged to act on a spring biasing a movable contact of the switch, the spring having a sufficiently low rate that the force required of the disc to move the spring does not affect the operating temperature of the disc to any significant extend and the spring being such that in use when the disc snap acts to close the switch contacts any movement of the disc beyond that required to provide sufficient contact pressure between the switch contacts for good electrical contact does not result in a substantially increased reaction force on the disc.

9. A thermostat as claimed in claim 8 wherein said spring comprises a leaf spring having a U-shaped slot therein defining a tongue free at one end, the operating member engaging the free end of the tongue.

10. A thermostat as claimed in claim 4 wherein said stop comprises a screw-threaded peg located in a screw threaded bore of a thermostat body member.

* * * * *